United States Patent [19]

Evinrude

[11] 4,235,183

[45] Nov. 25, 1980

[54] MARINE PROPULSION DEVICE INCLUDING PROPELLER PROTECTION MEANS

[75] Inventor: Ralph S. Evinrude, Jensen Beach, Fla.

[73] Assignee: Outboard Marine Corporation, Waukegan, Ill.

[21] Appl. No.: 879,445

[22] Filed: Feb. 21, 1978

Related U.S. Application Data

[62] Division of Ser. No. 738,528, Nov. 3, 1976, Pat. No. 4,096,819.

[51] Int. Cl.[2] ..... B63H 5/13; B63H 21/26

[52] U.S. Cl. ..... 440/71; 440/75

[58] Field of Search ..... 115/17, 18 R, 34 R, 115/35, 40, 42; 114/281, 274

[56] References Cited

U.S. PATENT DOCUMENTS

| | | | |
|---|---|---|---|
| 1,181,634 | 5/1916 | Bivert | 115/42 |
| 1,549,564 | 8/1925 | Slocum | 115/42 |
| 1,869,977 | 8/1932 | Modin | 115/42 |
| 2,140,099 | 12/1938 | Wise | 115/42 |
| 2,335,597 | 11/1943 | Mathewson | 115/42 |
| 2,690,728 | 10/1954 | Cavanaugh | 115/17 |
| 2,706,461 | 4/1955 | Smith | 115/17 |
| 2,748,400 | 6/1956 | Kregall | 114/281 |
| 2,791,196 | 5/1957 | Strang | 115/17 |
| 2,894,477 | 7/1959 | Brown | 115/42 |
| 3,433,195 | 3/1969 | Poole | 114/274 |

*Primary Examiner*—Edward R. Kazenske
*Assistant Examiner*—D. W. Keen
*Attorney, Agent, or Firm*—Michael, Best & Friedrich

[57] ABSTRACT

Disclosed herein is a marine propulsion device including a lower unit having a gear case, a laterally extending anti-cavitation plate extending above a propeller carried on a propeller shaft rotatably mounted in the gear case, and a pair of generally flat side fins, each of which has a laterally extending trailing edge located wholly forwardly of the propeller and which either extend laterally in coplanar relationship from the opposite sides of the gear case, extend laterally in coplanar relationship from the opposite sides of the lower unit at a location between the anti-cavitation plate and the gear case, extend outwardly and downwardly in an angular relationship from the opposite sides of the gear case, or extend laterally in coplanar relationship from the opposite sides of the lower end portion of a vertical fin extending downwardly from the gear case.

11 Claims, 6 Drawing Figures

MARINE PROPULSION DEVICE INCLUDING PROPELLER PROTECTION MEANS

This is a division of application Ser. No. 738,528 filed Nov. 3, 1976, now U.S. Pat. No. 4,096,819.

BACKGROUND OF THE INVENTION

The invention relates to marine propulsion devices such as outboard motors and stern drive units and, more particularly, to such marine propulsion devices including means for protecting the propeller against engagement with underwater objects.

Various guard arrangements have been proposed to protect the propeller of marine propulsion devices, such as outboard motors and stern drive units, against damage by floating or submerged objects such as driftwood and other debris. Prior art propeller guard arrangements typically are quite expensive, are limited somewhat to a particular propeller size or shape and/or tend to affect propeller performance. Examples of prior propeller guard constructions are disclosed in the Modin U.S. Pat. No. 1,869,977 issued Aug. 2, 1932, the Brown U.S. Pat. No. 2,894,447 issued July 14, 1959 and the Liaaen Canadian Pat. No. 509,171 issued Jan. 18, 1965.

SUMMARY OF THE INVENTION

The invention provides a marine propulsion device including a lower unit having a gear case normally submerged in water, a propeller shaft mounted in the gear case for rotation about an axis and carrying a propeller, and a pair of generally flat side fins affixed on the lower unit, each having a laterally extending trailing edge located wholly forwardly of the propeller. Each of the side fins preferably include a generally straight outermost edge extending forwardly of the trailing edge and generally parallel to the propeller shaft axis and a leading edge extending at an incline outwardly and rearwardly toward the outermost edge.

In one embodiment, the side fins are affixed on and extend laterally in substantially coplanar relationship from the opposite sides of the gear case with the leading edges of the side fins preferably extending from the forward end of the gear case.

In another embodiment, the side fins are affixed on the lower unit at a location between a laterally extending anti-cavitation plate extending above the propeller and the gear case and extend laterally in substantially coplanar relationship from the opposite sides of the lower unit.

In a further embodiment, the side fins are affixed on and extend downwardly and outwardly from the opposite sides of the gear case at an angular relationship to each other.

In a still further embodiment, the marine propulsion device includes a vertical extending fin extending downwardly from the gear case and the side fins are affixed on the vertical fin, preferably on the lower edge thereof, and extend laterally in substantially coplanar relationship from the opposite sides of the vertical fin.

One of the principal features of the invention is the provision of a marine propulsion device including simple means for protecting the propeller against contact with objects submerged in the water.

Another of the principal features of the invention is the provision of a marine propulsion device including such propeller protection means which does not significantly affect propeller performance.

Another of the principal features of the invention is the provision of a marine propulsion device including such propeller protection means which permits the use of propellers having a variety of sizes and blade configurations.

Other features and advantages of the embodiments of the invention will become apparent upon reviewing the following detailed description, the drawings and the appended claims.

Figure 1:
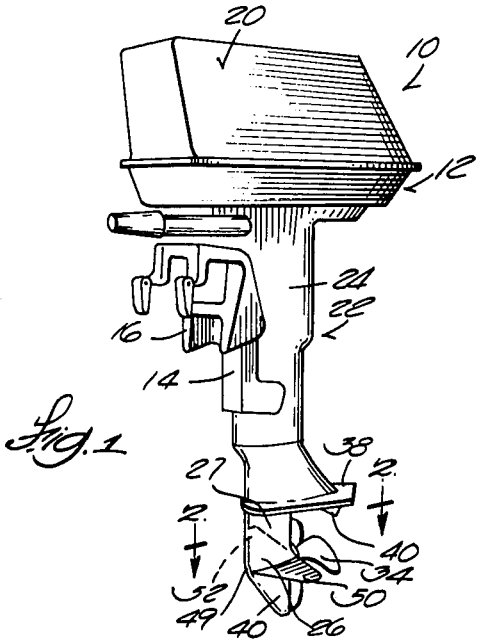
FIG. 1 is a perspective view of an outboard motor embodying various of the features of the invention.

Before explaining the embodiments of the invention in detail, it is to be understood that the invention is not limited in its application to the details of construction and the arrangements of the components set forth in the following description or illustrated in the drawing. The invention is capable of other embodiments and of being practiced and carried out in various ways. Also, it is to be understood that the phraseology and terminology employed herein is for the purposes of description and should not be regarded as limiting.

DESCRIPTION OF THE PREFERRED EMBODIMENTS

Figure 2:
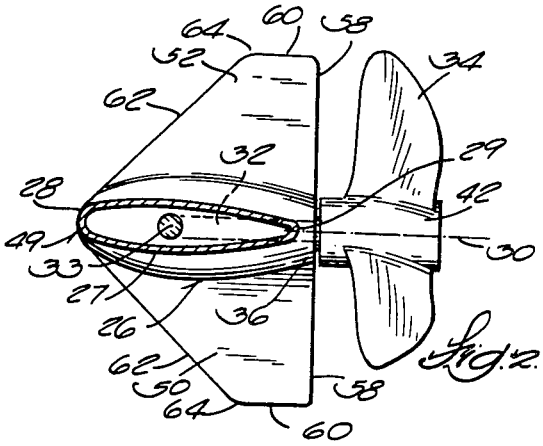
FIG. 2 is an enlarged sectional view taken along line 2—2 in FIG. 1.

Illustrated in the drawing is an outboard motor 10 including a propulsion unit 12 which is dirigible about a generally upright swivel post 14 carried by a transom bracket 16 which is mountable on the transom of a boat. The propulsion unit 12 includes a power head 20 which houses an engine (not shown) and is carried on a lower unit 22 having a drive shaft housing 24 rigidly supporting the power head 20. The lower unit 22 includes an enlarged, streamlined or torpedo-shaped gear case 26 which is rigidly attached to the lower end of the drive shaft housing 24 via a streamlined strut 27. The strut 27 has a curved leading edge or surface 28 and a more pointed trailing edge or surface 29 (FIG. 2).

Rotatably mounted in the gear case 26 for rotation about an axially extending axis 30 is a propeller shaft 32 which carries a propeller 34, for common rotation therewith, rearwardly of the aft end 36 of the gear case 26. The propeller shaft 32 is drivingly connected to a drive shaft 33 which is rotatably supported in the drive shaft housing 24 and is drivingly connected to the engine in the usual manner.

Extending laterally from the strut 27 above the gear case 26 and above the propeller 34 is a horizontal anit-cavitation plate 38 which extends rearwardly over the propeller 34. The anti-cavitation plate 38 is arranged to restrain the downward flow of air along the sides of the lower unit 22, particularly along the sides of the strut 27, and thereby retain water beneath the anti-cavitation plate 38 in a "solid" condition.

The lower portion of the lower unit 22, including the anti-cavitation plate 38, the gear case 26, and other components located below the anti-cavitation plate, normally is submerged in water when the boat is being propelled. The engine exhaust gases can be discharged under water through a discharge snout 40 extending rearwardly at an angle from the strut 27 beneath the anti-cavitation plate 38 and connected in communication with the interior of the drive shaft housing 24 as shown or discharged through a passage (not shown) within the propeller hub 42.

Extending downwardly from the gear case 26 and forwardly of the propeller 34 is a vertical fin or skeg 44 which is arranged to protect the propeller 34 against damage by objects in the water passing beneath the boat. The trailing surface or edge 46 of the skeg 44 is located forwardly of the propeller 34 and the leading surface or edge 48 of the skeg 44 is inclined downwardly and rearwardly from the forward end 49 of the gear case 26.

Figure 3:
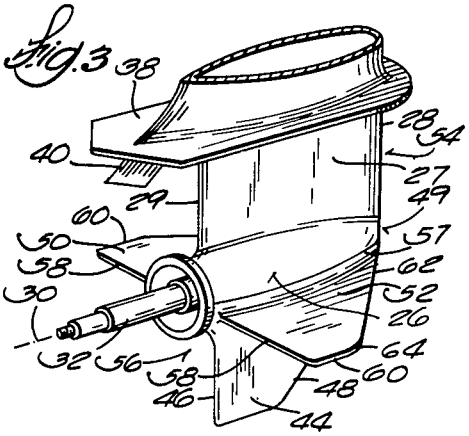
FIG. 3 is an enlarged, fragmentary view of the lower portion of the outboard motor shown in FIG. 1, shown with the propeller removed.

Additional means is provided for protecting the propeller 34 against engagement with underwater objects. More specifically, in the construction illustrated in FIGS. 1–3, such propeller protection means comprises a pair of generally flat, horizontally extending side fins 50 and 52 which are affixed on and extend laterally in substantially coplanar relationship from the opposite sides of the gear case 26 at or about the centerline or rotational axis 30 of the propeller shaft 32. In the specific construction illustrated, the gear case 26 has an upper portion 54 and a lower portion 56 which are suitably fastened together at a joint 57 located at the centerline or rotational axis 30 of the propeller shaft 32. The side fins 50 and 52 are disposed just below the joint 57 and are cast as an integral part of the lower gear case portion 56.

As best shown in FIG. 2, each of the side fins 50 and 52 have a laterally extending trailing edge 58 located wholly forwardly of the propeller 34, a generally straight outermost edge 60 extending forwardly from the trailing edge 58 in generally parallel relation to the centerline or rotational axis 30 of the propeller shaft 32, and a leading edge 62 extending at an incline rearwardly and outwardly from a location adjacent the forward end 49 of the gear case 26 toward the outermost edge 60. The trailing edges can extend forwardly at a small angle (e.g.,1°) with respect to a plane intersecting and extending perpendicularly to the centerline or rotational axis 30 of the propeller shaft 32. Each leading edge 62 preferably includes a convexly curved portion 64 which merges smoothly with the forward end portion of the outermost edge 60. The forward ends of the leading edges 62 can merge smoothly with the curved outer surface of the nose or forward end 49 of the gear case 26 as shown or can be spaced rearwardly from the forward end of the gear case.

With this arrangement, the side fins 50 and 52 not only serve as guards for deflecting objects submerged in the water away from the propeller as the boat is propelled forwardly, but for some reason not fully understood at this time, have been found to reduce the tendency for the propeller 34 to cavitate or ventilate. In addition, termination of the trailing edges of the fins wholly forwardly of the propeller avoids interference with the propeller wash. The overall width of the side fins 50 and 52 preferably approximate, but can be slightly less than, the outside diameter of the propeller 34. That is, the outermost edges 60 extend to a lateral position generally corresponding to the peripheral path of the propeller 34. Further, since the trailing edges 58 of the side fins 50 and 52 terminate forwardly of the propeller 34, a variety of propellers having different blade sizes and shapes can be used for any given propulsion unit.

Figure 4:
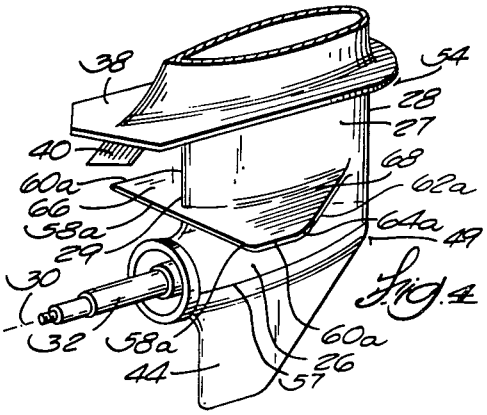
FIG. 4 is a view similar to FIG. 3 showing a modified side fin construction.
Figure 5:
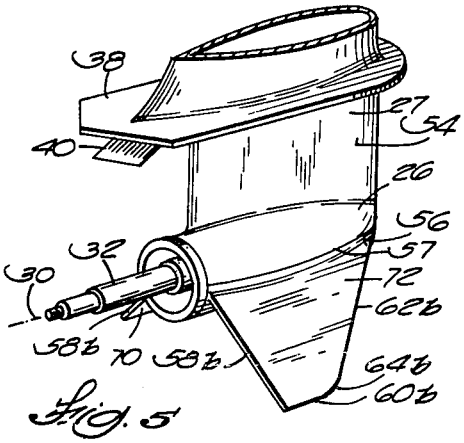
FIG. 5 is a view similar to FIG. 3 showing another modified side fin contruction.
Figure 6:
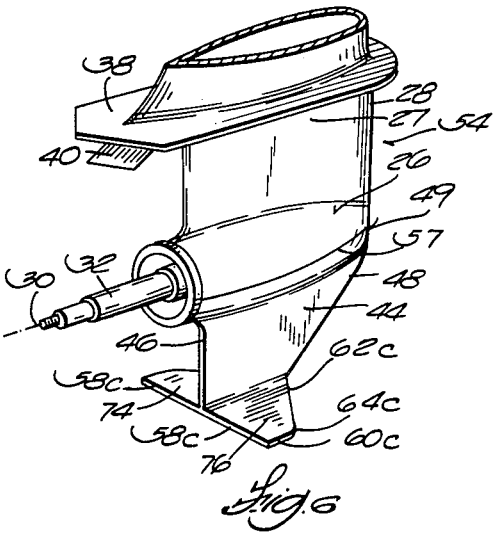
FIG. 6 is a view similar to FIG. 3 showing still another modified side fin construction.

FIGS. 4 through 6, illustrate alternate constructions for the side fins. Components constructed in the same general manner as the embodiment illustrated in FIGS. 1–3 have been assigned common reference numerals.

In the alternate construction illustrated in FIG. 4 the side fins 66 and 68 extend laterally in substantially coplanar relationship from the opposite sides of the strut 27 at a location between the anti-cavitation plate 38 and the gear case 26, preferably at a location on the lower unit above the gear case and beneath the anti-cavitation plate and within an imaginary extension parallel to the propeller axis of the periphery of the path of propeller rotation.

The laterally extending trailing edges **58*a* of the side fins 66 and 68 are located forwardly of the propeller 34. The outermost edges 60*a* , the leading edges 62*a*, and the curved portions 64*a* are arranged in the same general manner as in the embodiment illustrated in FIGS. 1–3. The forward ends of the leading edges 62*a* can be spaced rearwardly from the leading surface or edge 28 of the strut 27 as shown or can merge smoothly with the curved leading surface or edge 28 of the strut 27**.

In the alternate construction illustrated in FIG. 5, a vertical fin or skeg is omitted and the side fins 70 and 72 extend outwardly and downwardly from the opposite sides of the gear case 26 at an angular relationship to each other, and, as shown in FIG. 5, in general radial relation to the axis of the propeller shaft, preferably from a location on the lower portion 56 of the gear case 26 below the centerline or rotational axis 30 of the propeller shaft 32. The laterally extending trailing edges **58*b* of the side fins 70 and 72 are located forwardly of the propeller 34. The outermost edges 60*b*, the leading edges 62*b*, and the curved portions 64*b* are arranged in the same general manner as the embodiment illustrated in FIGS. 1–3, except the side fins 70 and 72 are slightly longer so that the outermost edges 60*b* extend laterally to a location generally corresponding to the peripheral path of the propeller 34**.

As with the embodiment illustrated in FIG. 4, the forward ends of the leading edges **62*b* can be spaced rearwardly from the forward end of the gear case 26 as shown or can merge smoothly with the curved outer surface of the nose or forward end of the gear case 26**.

In the alternate construction illustrated in FIG. 6, generally flat side fins 74 and 76 are affixed on the lower portion of the vertical fin or skeg 44 and extend laterally from the opposite sides of the skeg in substantially coplanar relationship. The laterally extending trailing edges **58*c* of the side fins 74 and 76 are located forwardly of the propeller and can be generally co-terminus with the trailing surface or edge 46 of the skeg 44. The outermost edges 60*c*, the leading edges 62*c*, and the curved portions 64*c* are arranged in the same general manner as in the embodiment illustrated in FIGS. 1–3. The lowermost surfaces of the side fins 74 and 76 can be generally coplanar with the lowermost edge or surface of the skeg 44 with the forward ends of the leading edges 62*c* being generally co-terminus with the leading surface or edge 48 of the skeg 44. If desired, the side fins 74 and 76 can be affixed on the skeg 44 at a location intermediate the lowermost edge or surface thereof and the gear case 26 and the forward ends of the leading edges 62 can be spaced rearwardly from the leading surface or edge 48 of the skeg 44**.

Various features of the invention are set forth in the following claims:

What is claimed is:

1. A marine propulsion device comprising a lower unit including a gear case normally submerged in water, a propeller shaft mounted in said gear case for rotation about an axis and carrying a propeller, a laterally extending anti-cavitation plate extending above said propeller, and a pair of generally flat, horizontally extending side fins affixed on and extending laterally in substantially coplanar relationship from the opposite sides of said lower unit at a location on said lower unit above said gear case and beneath said anti-cavitation plate, and within an imaginary extension parallel to said propeller axis of the periphery of the path of propeller rotation, each of said fins having a laterally extending trailing edge located wholly forwardly of said propeller.

2. A marine propulsion device according to claim 1 wherein said gear case has a forward end, and wherein each of said side fins includes a generally straight outermost edge extending forwardly from said trailing edge and generally parallel to said propeller shaft axis, and a leading edge extending at an incline outwardly and rearwardly from adjacent said gear case forward end toward said outermost edge.

3. A marine propulsion device according to claim 1 wherein said leading edge includes a convexly curved portion smoothly merging with said outermost edge.

4. A marine propulsion device according to claim 1 wherein said outermost edges of said side fins extend laterally to a location generally corresponding to the peripheral path of said propeller.

5. A marine propulsion device comprising a lower unit including a gear case normally submerged in water, a propeller shaft rotatably mounted in said gear case for rotation about an axis and carrying a propeller, and a pair of generally flat fins affixed on and extending outwardly and downwardly from the opposite sides of said gear case at an angular relationship to each other and in generally radial relation to the axis of said propeller shaft, each of said fins having a laterally extending trailing edge located wholly forwardly of said propeller.

6. A marine propulsion device according to claim 5 wherein said gear case has a forward end, and wherein each of said side fins includes a generally straight outermost edge extending forwardly from said trailing edge and generally parallel to said propeller shaft axis, and a leading edge extending at an incline outwardly and rearwardly from adjacent said gear case forward end toward said outermost edge.

7. A marine propulsion device according to claim 6 wherein said leading edge includes a convexly curved portion smoothly merging with said outermost edge.

8. A marine propulsion device according to claim 6 wherein said outermost edges of said side fins extend laterally to a location generally corresponding to the peripheral path of said propeller.

9. A marine propulsion device comprising a lower unit including a gear case normally submerged in water, a propeller shaft mounted in said gear case for rotation about an axis and carrying a propeller, a vertical fin extending downwardly from said gear case and having a lower end portion, a lowermost edge, and leading and trailing edges, and a pair of generally flat, horizontal fins affixed on said vertical fin lower end portion and extending laterally in substantially coplanar relationship from the opposite sides of said lower end portion of said vertical fin, each of said horizontal fins having a lowermost surface which is generally coplanar with said vertical fin lowermost edge, each of said horizontal fins having a laterally extending trailing edge located wholly forwardly of said propeller in generally coplanar relation to said vertical fin trailing edge, and each of said horizontal fins including a generally straight outermost edge portion extending forwardly from said trailing edge and generally parallel to said propeller shaft axis, and a leading edge extending at an incline from adjacent said vertical fin leading edge toward said outermost edge portion.

10. A marine propulsion device according to claim 9 wherein said horizontal fin leading edge includes a convexly curved portion smoothly merging with said outermost edge.

11. A marine propulsion device according to claim 9 wherein said outermost edges of said horizontal fins extend laterally to a location generally corresponding to the peripheral path of said propeller.

* * * * *